US010731389B2

(12) United States Patent
Smart et al.

(10) Patent No.: US 10,731,389 B2
(45) Date of Patent: Aug. 4, 2020

(54) RETRACTABLE HANDLE ARRANGEMENT

(71) Applicant: Jaguar Land Rover Limited, Whitley, Coventry, Warwickshire (GB)

(72) Inventors: Sean Smart, Rugby (GB); Andy Mascia, Coventry (GB); Edward Smith, Coventry (GB)

(73) Assignee: JAGUAR LAND ROVER LIMITED, Whitley, Coventry (GB)

( * ) Notice: Subject to any disclaimer, the term of this patent is extended or adjusted under 35 U.S.C. 154(b) by 110 days.

(21) Appl. No.: 14/431,167

(22) PCT Filed: Sep. 25, 2013

(86) PCT No.: PCT/EP2013/070020
§ 371 (c)(1),
(2) Date: Mar. 25, 2015

(87) PCT Pub. No.: WO2014/049026
PCT Pub. Date: Apr. 3, 2014

(65) Prior Publication Data

US 2015/0233153 A1 Aug. 20, 2015

(30) Foreign Application Priority Data

Sep. 25, 2012 (GB) ..... 1217113.8

(51) Int. Cl.
*E05B 85/10* (2014.01)
*E05B 81/90* (2014.01)
(Continued)

(52) U.S. Cl.
CPC ..... *E05B 85/103* (2013.01); *E05B 81/28* (2013.01); *E05B 81/76* (2013.01); *E05B 81/90* (2013.01);
(Continued)

(58) Field of Classification Search
CPC ..... E05B 85/103; E05B 1/0092; E05B 5/003; E05B 5/006; E05B 85/18; E05B 81/77;
(Continued)

(56) References Cited

U.S. PATENT DOCUMENTS 6,463,773 B1 * 10/2002 Dimig ..... E05B 83/36 292/201
6,698,262 B2 3/2004 Wittwer
(Continued)

FOREIGN PATENT DOCUMENTS

CN 1587608 A 3/2005
CN 1609745 A 4/2005
(Continued)

OTHER PUBLICATIONS

Lusciousgarage "Tesla Model S door handle," Aug. 5, 2012. Youtube. https://www.youtube.com/watch?v=0ji92dFHLhA (Year: 2012).*
(Continued)

*Primary Examiner* — Kristina R Fulton
*Assistant Examiner* — Faria F Ahmad
(74) *Attorney, Agent, or Firm* — Reising Ethington P.C.

(57) ABSTRACT

A handle arrangement for a vehicle comprising: a handle moveable between a slowed position and a deployed position; a drive mechanism for controlling the handle position; a sensor for detecting a force applied to the handle when in the deployed position, which force is directed so as to urge the handle into the stowed position; wherein upon detecting the force the handle arrangement is arranged to move the handle from the deployed position to the stowed position.

20 Claims, 10 Drawing Sheets

(51) Int. Cl.

| | |
|---|---|
| ***E05B 81/28*** | (2014.01) |
| ***E05B 81/76*** | (2014.01) |
| ***E05B 81/06*** | (2014.01) |
| ***E05B 17/10*** | (2006.01) |
| ***E05B 5/02*** | (2006.01) |
| ***E05B 5/00*** | (2006.01) |
| ***E05B 1/00*** | (2006.01) |
| ***E05B 85/18*** | (2014.01) |
| ***E05B 81/74*** | (2014.01) |

(52) U.S. Cl.
CPC ..... *E05B 85/107* (2013.01); *E05B 1/0092* (2013.01); *E05B 5/003* (2013.01); *E05B 5/006* (2013.01); *E05B 17/10* (2013.01); *E05B 81/06* (2013.01); *E05B 81/74* (2013.01); *E05B 85/18* (2013.01); *Y10S 292/31* (2013.01); *Y10T 70/5889* (2015.04); *Y10T 292/57* (2015.04)

(58) Field of Classification Search
CPC ..... E05B 81/74; E05B 81/76; E05B 81/28; E05B 81/90; E05B 85/107; E05B 81/06; E05B 85/10; Y10S 292/30; Y10S 292/31; Y10S 292/22; Y10T 292/57; Y10T 70/5889
USPC ..... 292/336.3, DIG. 22, DIG. 30, DIG. 31
See application file for complete search history.

(56) References Cited

U.S. PATENT DOCUMENTS

| | | | | |
|---|---|---|---|---|
| 6,937,929 | B2 | 8/2005 | Hayasaka | |
| 7,375,299 | B1 | 5/2008 | Pudney | |
| 8,452,498 | B2 | 5/2013 | Flanagan | |
| 8,701,353 | B2 * | 4/2014 | Patel | E05B 85/107 49/503 |
| 8,786,401 | B2 * | 7/2014 | Sobecki | E05B 85/103 340/5.72 |
| 8,919,047 | B2 * | 12/2014 | Johnsrud | E05B 85/103 292/336.3 |
| 8,985,648 | B2 * | 3/2015 | Muller et al. | E05B 85/107 292/336.3 |
| 9,062,478 | B2 | 6/2015 | Bingle et al. | |
| 9,080,352 | B2 * | 7/2015 | Aerts | E05B 85/103 |
| 9,103,143 | B2 * | 8/2015 | Wheeler | E05B 85/00 |
| 9,605,452 | B2 * | 3/2017 | Yoshino | E05B 85/103 |
| 10,072,447 | B2 * | 9/2018 | Fujiwara | B60Q 1/323 |
| 10,280,658 | B2 * | 5/2019 | Halliwell | E05B 85/107 |
| 2008/0163555 | A1 * | 7/2008 | Thomas | E05B 85/10 49/460 |
| 2009/0205383 | A1 * | 8/2009 | Katagiri | E05B 17/18 70/237 |
| 2010/0007463 | A1 * | 1/2010 | Dingman | B60Q 1/2669 340/5.72 |
| 2011/0148575 | A1 * | 6/2011 | Sobecki | E05B 85/103 340/5.64 |
| 2011/0215597 | A1 * | 9/2011 | Weum | E05B 47/00 292/144 |
| 2012/0049544 | A1 | 3/2012 | Kwon | |
| 2012/0119524 | A1 * | 5/2012 | Bingle | E05B 85/107 292/336.3 |
| 2012/0128344 | A1 | 5/2012 | Kwon | |
| 2012/0247161 | A1 * | 10/2012 | Muller | E05B 85/107 70/91 |
| 2013/0076048 | A1 * | 3/2013 | Aerts | E05B 85/103 292/336.3 |
| 2013/0127185 | A1 * | 5/2013 | Lang | E05B 81/77 292/336.3 |
| 2014/0000167 | A1 * | 1/2014 | Patel | E05B 81/34 49/32 |
| 2016/0222703 | A1 * | 8/2016 | Koizumi | E05B 81/77 |
| 2016/0251880 | A1 * | 9/2016 | Bingle | E05B 81/76 701/49 |
| 2017/0114577 | A1 * | 4/2017 | Beshke, Sr. | E05B 81/76 |

FOREIGN PATENT DOCUMENTS

| | | | |
|---|---|---|---|
| CN | 1730871 | A | 2/2006 |
| CN | ON101023232 | A | 8/2007 |
| CN | ON101551007 | A | 10/2009 |
| CN | ON102383649 | A | 3/2012 |
| DE | 102008030580 | A1 | 1/2009 |
| EP | 1072466 | A2 | 1/2001 |
| FR | 2889553 | A1 | 2/2007 |
| GB | 2492231 | A | 12/2012 |
| WO | 2012021782 | A2 | 2/2012 |

OTHER PUBLICATIONS

English Translation of Chinese Office Action corresponding to CN application No. 201380060443.3, dated Apr. 1, 2016, 10 pages.
GB Combined Search and Examination Report for corresponding application No. 1217113.8, dated Feb. 11, 2013, 7 pages.
International Search Report for application No. PCT/EP2013/070020, dated Feb. 26, 2014, 4 pages.
Written Opinion for application No. PCT/EP2013/070020, dated Feb. 26, 2014, 6 pages.
Chinese Office Action with English translation corresponding to Chinese Application No. 201711266530, dated Mar. 15, 2019, 11 pages.
Chinese Office Action with English translation corresponding to Chinese application No. 201711266530, dated Oct. 15, 2019, 16 pages.

* cited by examiner

RETRACTABLE HANDLE ARRANGEMENT

TECHNICAL FIELD

The present invention relates to a retractable handle arrangement for a door or other closure, and a method of deploying a retractable door handle arrangement. Aspects of the invention relate to a handle arrangement to a body component, to a method and to a vehicle.

BACKGROUND

The invention will be described in the context of a car door but it can be used with other closures on a vehicle, such as a tailgate, or with other types of vehicle, such as aircraft. Indeed, in a broad sense, the retractable handle arrangement of the invention can be used in non-vehicular applications.

The demands of aesthetics, aerodynamics and wind-noise control often make it desirable for a door handle to lie flush with the surrounding door skin of a vehicle. Flap-type door handles may be used for this reason. Such handles comprise a typically top-pivoted flap that is pulled against spring bias and hence pivoted outwardly with respect to the surrounding door skin to unlatch the door. A finger recess is usually provided in the door skin adjacent to, most commonly underneath, the flap of the handle. This recess gives finger access to the rear of the handle so that the handle may be pulled to unlatch and open the door.

A flap-type handle tends to be awkward to use and cannot be grasped as comfortably or satisfyingly as other handle types. Perhaps the most convenient handle type has a protruding bar-like grab or handgrip that may be gripped in the users hand, an example being a strap-type handle in which the handgrip is part of a loop.

Strap-type handles have particular benefits over flap-type handles in terms of ergonomics and load transferral: for example, when using a flap-type handle, it is not possible for the user to choose whether to use an overhand or underhand grip style. Also, a flap-type handle constrains where the handle may be positioned on the vehicle with respect to the user's stance. Unfortunately, however, the protruding handgrip of a strap-type handle does not have the benefits of flush mounting.

A flap-type handle with its associated finger recess is also an aesthetic constraint. There have therefore been several proposals in the prior art to provide a finger recess with a hinged cover plate that lies flush with the door skin and with the adjacent flap-type handle but that pivots inwardly to admit the user's fingers to operate the handle. However, this cover plate doss not solve the inherent problems of a flap-type handle; if anything, it makes the handle more difficult to use. Also, arguably, a cover plate may look no better than leaving the finger recess uncovered.

To solve some of these problems and to offer a 'surprise and delight' feature, some, flush-mounted door handles are retractably mounted to a vehicle. This means that the handle can move between two states; a stowed or retracted state in which the handle is flush-mounted and a deployed or extended stale in which the handle stands proud of the surrounding bodywork to be easier to grasp. Movement of the handle between the slowed and deployed states may be effected by means of an automated mechanism.

Once in the deployed state, the handle can then be pulled to open the door. This involves moving the handle to a third, operative state to unlatch the door, typically by pivoting the deployed handle against spring bias. In moving from the deployed state to the operative state, the handle may unlatch the door mechanically, for example by pulling a Bowden cable acting on the door latch, or electrically, for example by switching a solenoid acting on the door latch.

A problem exists with such retractable door handles in that the handle must be in the deployed state before a user can grasp the handle to open the door. In wet and freezing conditions the door handle arrangement may become iced-up. Thus, in the case that the deployment of the handle is effected by means of an automated mechanism ice may prevent the handle from deploying, leaving the user no way of opening the door until the door handle has been de-iced, which is inconvenient and time-consuming.

Furthermore, another problem with a retractable door handle of the kind described above exists where an automated mechanism is used to retract the door handle from the deployed state to the stowed state. In this case, there is a danger that a user's fingers may become trapped between the handle and the surrounding door skin in the case that the user is holding the handle as it retracts.

Moreover, a retractable door handle of the Hind described above may be susceptible to damage in the case of abuse by a user. Such damage may occur in the event that a user tries to force the door handle from the deployed state into the stowed state thereby applying stresses which could damage the mechanism.

Additionally, a problem exists with such retractable door handles in that the space available within the door for receiving and mounting the door handle and associated deployment mechanism is restricted; the problem is exacerbated when the door handle in mounted flush with the outer skin of the door, furthermore additional space limitations are introduced by inclusion of other components within the door cavity, such as a window and retraction mechanism for retracting the window.

Furthermore, another problem associated with a retractable handle arrangement is to provide the user with the associated functionality, such as means to look and unlock the door, in a way which is intuitive and simple to use.

It is an object of the present invention to provide a retractable handle arrangement which substantially overcomes or mitigates at least some of the above mentioned problems.

SUMMARY

Aspects of the invention relate to a handle arrangement, to a body component, to a method and to a vehicle as claimed in the appended claims.

According to one aspect, the invention provides a handle arrangement for a vehicle comprising:

- a handle moveable between a stowed position and a deployed position;
- a drive mechanism for controlling the handle position;
- a sensor for detecting a force applied to the handle when in the deployed position, which force is directed so as to urge the handle into the stowed position;
- wherein upon detecting the force the drive mechanism is configured to move the handle from the deployed position to the stowed position.

This provides that the handle is intuitive to operate.

The handle arrangement may comprise a feedback device for indicating to a user that sufficient force has been applied to the handle to initiate moving the handle from the deployed position to the stowed position.

The feedback device may comprise one or more of an aural feedback device, a haptic feedback device and a visual feedback device.

The handle arrangement may be coupled to a lock mechanism of a door or other closure of the vehicle and wherein upon detecting the force the lock mechanism is arranged to be activated so as to lock the door or other closure.

The handle arrangement may be arranged to activate a dead lock mechanism of the door or other closure of the vehicle upon detecting application of a second force on the handle.

The handle may be pivotally mounted about a handle pivot axis disposed between first and second ends of the handle.

The handle pivot axis may extend through and be disposed within the handle.

The handle may comprise a longitudinal axis extending between first and second ends of the handle and the handle pivot axis may be arranged substantially perpendicularly to the longitudinal axis.

The handle may be coupled to the drive mechanism such that the handle may be moved from the stowed position to the deployed position manually, independently of the drive mechanism.

The handle may be at least temporarily decouplable from the drive mechanism.

The handle arrangement may comprise a return spring for returning the handle from the deployed position to the stowed position.

The handle arrangement may comprise a key barrel for receiving a key blade. The key barrel may be disposed behind the handle such that the handle conceals the key barrel in the stowed position.

The handle may be pivotally mounted about a handle pivot axis disposed between the first and second ends, the handle pivot axis being arranged such that the key barrel remains substantially behind the handle in the stowed position and the key barrel and handle are disposed in the same plane which plane is substantially perpendicular to a plane comprising the handle pivot axis.

The handle may have a first end and a second end, wherein the handle comprises an unlock button disposed proximate a first end of the handle such that a user may deploy the handle with one hand.

The unlock button may be located such that the user can press the unlock button with a thumb to urge the handle to move to the deployed position and grasp the second end of the handle with one or more fingers.

The handle arrangement may comprise:

a sensor for detecting a force applied to the handle when in the stowed position, which force is directed so as to urge the handle into the deployed position;

wherein upon detecting the force the drive mechanism is configured to move the handle from the slowed position to the deployed position.

The handle arrangement may comprise:

a sensor for defecting a force applied to the handle when in the stowed position, which force is directed so as to urge the handle into the stowed position;

wherein upon detecting the force the drive mechanism is configured to move the handle from the stowed position to the deployed position.

According to a further aspect, the present invention provides a vehicle having a plurality of doors or other closures each of which comprises a handle arrangement as described above, wherein a control unit is coupled to all of the handle arrangements provided on the vehicle.

The control unit may be arranged to determine whether to move one or all of the handle arrangements from the deployed position to the stowed position based upon a parameter of the force applied to one or more of the handles when in the deployed position and control the drive mechanism of each handle arrangement accordingly.

The vehicle may comprise a locking mechanism on each of the doors or other closures. The control unit may be arranged to activate the locking mechanism so as to lock one or all of the doors or other closures based upon a parameter of the force applied to one of the handles.

The parameter may be one of the following:

duration of the force;

magnitude of the force;

direction of the force; and number of times force is applied.

According to another aspect, the present invention provides a body component for a vehicle comprising an outer panel comprising a cut out or aperture for receiving the handle of the handle arrangement as described above wherein the cut out or aperture defines an edge in the panel and wherein the panel receives the handle within the cutout or aperture as a close fit and the outer surface of the handle is shaped to match the cut out or aperture and lies flush with the outer panel when the handle is in a stowed condition.

A flexible sealing member may be provided between the handle and the edge of the panel defined by the cut out or aperture.

According to a further aspect, the present invention provides a vehicle having a handle arrangement as described above.

The vehicle may comprise one or more doors and a handle may act as a lock status indicator for each individual door.

According to an aspect of the invention for which protection is sought, there is provided a handle arrangement for a vehicle comprising:

a handle having a first end and a second end, wherein the handle is moveable between a stowed position and a deployed position;

a drive mechanism for controlling the handle position;

a sensor for detecting a force applied to the handle when in the deployed position, which force is directed so as to urge the handle into the stowed position;

wherein upon defecting the force the handle arrangement moves the handle from the deployed position to the stowed position.

This provides that the handle is intuitive to operate.

In some embodiments the handle arrangement comprises a feedback device for indicating to a user that sufficient force has been applied to the handle to initiate moving the handle from the deployed position to the stowed position. Optionally the feedback device is a haptic feedback device, an aural feedback device or a visual feedback device.

Optionally, the handle arrangement is coupled to a lock mechanism of a door or other closure of the vehicle and wherein the lock mechanism is activated so as to lock the door or other closure upon defecting the force.

In some embodiments the handle arrangement activates a dead lock mechanism of the doer or other closure of the vehicle upon detecting application of a second force on the handle.

According to another aspect of the invention for which protection is sought, there is provided a handle arrangement for a vehicle comprising:

a handle having a first end and a second end, wherein the handle is moveable between a stowed position and a deployed position;

a drive mechanism for controlling the handle position;

a sensor for detecting a force applied to the handle when in the stowed position, which force is directed so as to urge the handle into the deployed position;

wherein upon detecting the force the handle arrangement moves the handle from the stowed position to the deployed position.

According to a further aspect of the invention for which protection is sought there is provided a handle arrangement for a vehicle comprising:

a handle having a first end and a second end, wherein the handle is moveable between a stowed position and a deployed position;

a drive mechanism for controlling the handle position;

a sensor for detecting a force applied to the handle when in the stowed position, which force is directed so as to urge the handle into the stowed position;

wherein upon detecting the force the handle arrangement moves the handle from the stowed position to the deployed position.

Optionally, the handle is pivotally mounted about a handle pivot axis disposed between the first and second ends.

The handle pivot axis may extend through and may be disposed within the handle.

In some embodiments the handle comprises a longitudinal axis extending between the first and second end and the handle pivot axis is arranged substantially perpendicularly to the longitudinal axis.

According to yet a further aspect of the invention for which protection is sought, there is provided a vehicle having a plurality of doors or other closures each of which comprises a handle arrangement as described herein above wherein a control unit is coupled to all of the handle arrangements provided on the vehicle.

In some embodiments the control unit determines whether to move one or ail of the handle arrangements from the deployed position to the stowed position based upon a parameter of the force applied to one or more of the handle when in the deployed position and controls the drive mechanism of each handle arrangement accordingly.

Optionally, the vehicle composes a locking mechanism on each of the each of doors or other closures, wherein the control unit activates the locking mechanism so as to lock one or all of the doors or other closures based upon a parameter of the force applied to one of the handles.

The parameter may be one of the following: duration of the force; magnitude of the force; direction of the force; or number of forces applied.

According to still a further aspect of the invention for which protection is sought, there is provided a handle arrangement for a vehicle comprising:

a handle having a first end and a second end, wherein the handle is moveable between a stowed position and a deployed position;

a drive mechanism for controlling the handle position;

wherein the handle is coupled to the drive mechanism such that the handle may be moved from the stowed position to the deployed position manually, independently of the drive mechanism.

This has the advantage that the handle is operable in circumstances in which the drive means falls to deploy the handle, for example in the event of an electrical power failure or malfunction of the drive means. It also provides that a user may assist the drive means in deploying the handle for example if the handle is heavily iced to the door skin.

In some embodiments the handle is at least temporarily decouplable from the drive mechanism.

Optionally, the handle arrangement comprises a return spring for returning the handle from the deployed position to the stowed position.

This reduces the likelihood of trapping a user's fingers or clothing in the handle.

Optionally, the handle arrangement comprises a key barrel for receiving a key blade, wherein the key barrel is disposed behind the handle such that the handle conceals the key barrel in the stowed position.

This reduces the likelihood of ingress of dirt or moisture in to the key barrel; it also hampers tampering with the key barrel.

In some embodiments the handle is pivotally mounted about a handle pivot axis disposed between the first and second ends, the handle pivot axis being arranged such that the key barrel remains substantially behind the handle in the stowed position and the key barrel and handle are disposed in the same plane which plane is substantially perpendicular to a plane comprising the handle pivot axis.

According to yet an another aspect of the invention for which protection is sought, there is provided a handle arrangement for a vehicle comprising a handle provided within a door, the handle having a first end and a second end, the handle being moveable between a stowed position and a deployed position the handle arrangement comprising a drive mechanism for controlling the handle position, wherein the handle comprises an unlock button disposed proximate a first end of the handle such that a user may deploy the handle with one hand.

Optionally, the unlock button is located such that the user can press the unlock button with a thumb to urge the handle to move to a deployed condition and grasp the second end of the handle with one or more fingers.

According to still another aspect of the invention for which protection is sought, there is provided a handle arrangement for a vehicle comprising a handle provided within a door, the handle having a first end and a second end, wherein the handle is pivotally mounted about a handle pivot axis disposed between the first and second ends, the handle being moveable between a stowed position and a deployed position in which the first end is rotated so as to extend into a door cavity and the second end is rotated to extend outwardly from an outer surface of the door, the handle arrangement comprising a drive mechanism for controlling the handle position, wherein the handle comprises an unlock button disposed between the first end and the handle pivot axis such that pressing on the unlock button urges the handle to rotate towards the deployed position.

According to still yet another aspect of the invention for which protection is sought, there is provided a retractable handle arrangement comprising:

a handle comprising a first end and a second end and being movable between stowed and deployed states;

the handle being pivotally mounted about a handle pivot axis disposed between the first and second ends;

an operating member extending from the handle;

a first lever arm for moving the handle from a stowed position to a deployed position;

a second lever arm for operating a release mechanism in response to moving the handle from the deployed position to an operative position;

a motor;

the first lever arm being coupled to the motor by a transmission means;

wherein the first lever arm operatively engages with the operating member when the motor is driven in a first direction; and wherein the operating member operatively engages with the second lever arm when the handle is moved from the deployed position to an operative position.

Optionally, the first lever arm is pivotally mounted about a lever pivot axis on a first side of the operating member.

Optionally, the second lever arm pivotally mounted about a second lever pivot axis on a second side of the operating member.

Optionally, the operating member is disposed substantially perpendicularly to the handle.

Optionally, the lever pivot axis is mounted substantially perpendicularly to the handle pivot axis and the second lever pivot axis is mounted substantially perpendicularly to the handle pivot axis.

Advantageously, the transmission means may be configured such that the speed of travel of the handle is greater during a second deployment phase than during an initial deployment phase. Thus, the deployment time of the handle can be optimized so that a user does not have to wait for a long time for the handle to reach the deployed state.

The transmission means may be configured such that the handle is gradually brought to a stop in the deployed state during a third deployment phase. Thus, the handle can be brought to a gradual stop so as to provide a refined and elegant appearance.

In an embodiment, the retractable handle arrangement comprises a return spring arranged so as to bias the handle toward the stowed state.

Optionally, the retractable handle arrangement comprises a return spring arranged so as to bias the second lever arm toward a latched position.

According to still yet a further aspect of the invention for which protection is sought, there is provided a body component for a vehicle comprising an outer panel comprising a cut out or an aperture for receiving the handle of the retractable handle arrangement as described hereinabove wherein the cut out or aperture defines an edge in the panel and wherein the panel receives the handle within the cut out or aperture as a close fit and the outer surface of the handle is shaped to match the cut out or aperture and lies flush with the outer panel when the handle is in a stowed condition.

Optionally, a flexible sealing member is provided between the handle and the edge of the panel defined by the cut out or aperture.

According to a further still aspect of the invention for which protection is sought there is provided a method of operating a motor-driven retractable handle arrangement comprising a handle movable, about a handle pivot axis, via a drive means for moving the handle from a stowed position to a deployed position, the method comprising actuating the drive means in a first direction, whereby moving the handle from a stowed position to a deployed position.

Optionally, the retractable handle arrangement comprises a transmission means arranged to couple the drive means to a first lever, the first lever being coupled to the handle for moving the handle from the stowed position to the deployed position, and the method comprises actuating the drive means to drive the transmission means in a first direction, whereby pivoting the first lever arm about a lever pivot axis, to engage a first side of an operating member extending from the handle so as to move the handle from the stowed position to the deployed position.

Optionally, the method comprises moving the handle at a greater speed during a second deployment phase than during an initial deployment phase.

The method may, in some embodiments, comprise bringing the handle to a gradual stop in the deployed position during a third deployment phase.

In some embodiments, the method comprises rotating the handle in a first direction about the handle pivot axis from the deployed position to an operative position, whereby engaging the second lever arm with a second side of an operating member, the second side opposing the first side, and rotating the second lever arm about a second lever pivot axis, the second lever pivot axis being mounted substantially perpendicularly to the handle pivot axis, such that the second lever arm operates a door release mechanism.

Optionally, the method comprises:

rotating the handle in a second direction about the handle pivot axis from the deployed position to the stowed position, and actuating the motor to drive the transmission means in a second direction, whereby pivoting the first lever arm about a lever pivot axis, so as to move the handle from the deployed position to the stowed position.

In some embodiments the handle is biased to return to the stowed position by a resilient biasing device, and the method comprises:

actuating the motor to drive the transmission means in a second direction, so as to allow the resilient biasing device to drive the handle from the deployed position to the stowed position.

Optionally, the handle arrangement comprises a sensor for detecting movement of, or a force applied to, the handle, and the method comprises:

detecting said movement or force and actuating the drive means in a second direction, whereby moving the handle from the deployed position to the stowed position.

Optionally, the handle arrangement comprises a control unit, and the method comprises:

determining an action to be taken based upon a parameter or characteristic of the force or movement applied to the handle.

In some embodiments the handle arrangement is provided on each door or other closure of a vehicle and each door or other closure comprises locking mechanism and a dead lock mechanism, and the method comprises:

detecting a predefined parameter of the force or movement applied to the handle, and either activating the locking mechanism provided on that door or other closure of the vehicle which comprises the handle arrangement to which is the force or movement is applied, or activating the locking mechanism provided on all doors or other closures of a vehicle, or activating the dead lock mechanism provided on that door or other closure of the vehicle which comprises the handle arrangement to which is the force or movement is applied, or activating the dead lock mechanism provided on all doors or other closures of the vehicle.

According to a yet a further still aspect of the invention for which protection is sought, there is provided a method for operating a motor-driven retractable handle arrangement comprising a handle movable, about a handle pivot axis, via a drive means for moving the handle from a stowed position to a deployed position, the method comprising manually moving the handle from a stowed position to a deployed position, whereby decoupling the handle from the drive means.

According to an additional aspect of the invention for which protection is sought, there is provided a vehicle having a handle arrangement or adapted to use a method as described hereinabove.

Preferably, the vehicle comprises one or more doors and a handle acts as a look status indicator for each individual door.

Within the scope of this application if is expressly envisaged that the various aspects, embodiments, examples and alternatives set out in the preceding paragraphs. In the claims and/or in the following description and drawings, and in particular the individual features thereof, may be taken independently or in any combination. Features described in connection with one embodiment are applicable to all embodiments, unless such features are incompatible.

BRIEF DESCRIPTION OF THE DRAWINGS

One or more embodiments of the invention will now be described, by way of example only, with reference to the accompanying drawings, in which:

FIG. 8 is rear plan view of the mechanism of the door handle arrangement of FIG. 1, with the door handle in the operative state;

DETAILED DESCRIPTION

Detailed descriptions of specific embodiments of a handle arrangement, a method and a vehicle of the present invention are disclosed herein. It will be understood that the disclosed embodiments are merely examples of the way in which certain aspects of the invention can be implemented and do not represent an exhaustive list of all of the ways the invention may be embodied. Indeed, it will be understood that the handle arrangement, method and the vehicle described herein may be embodied in various and alternative forms. The figures are not necessarily to scale and some features may be exaggerated or minimized to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
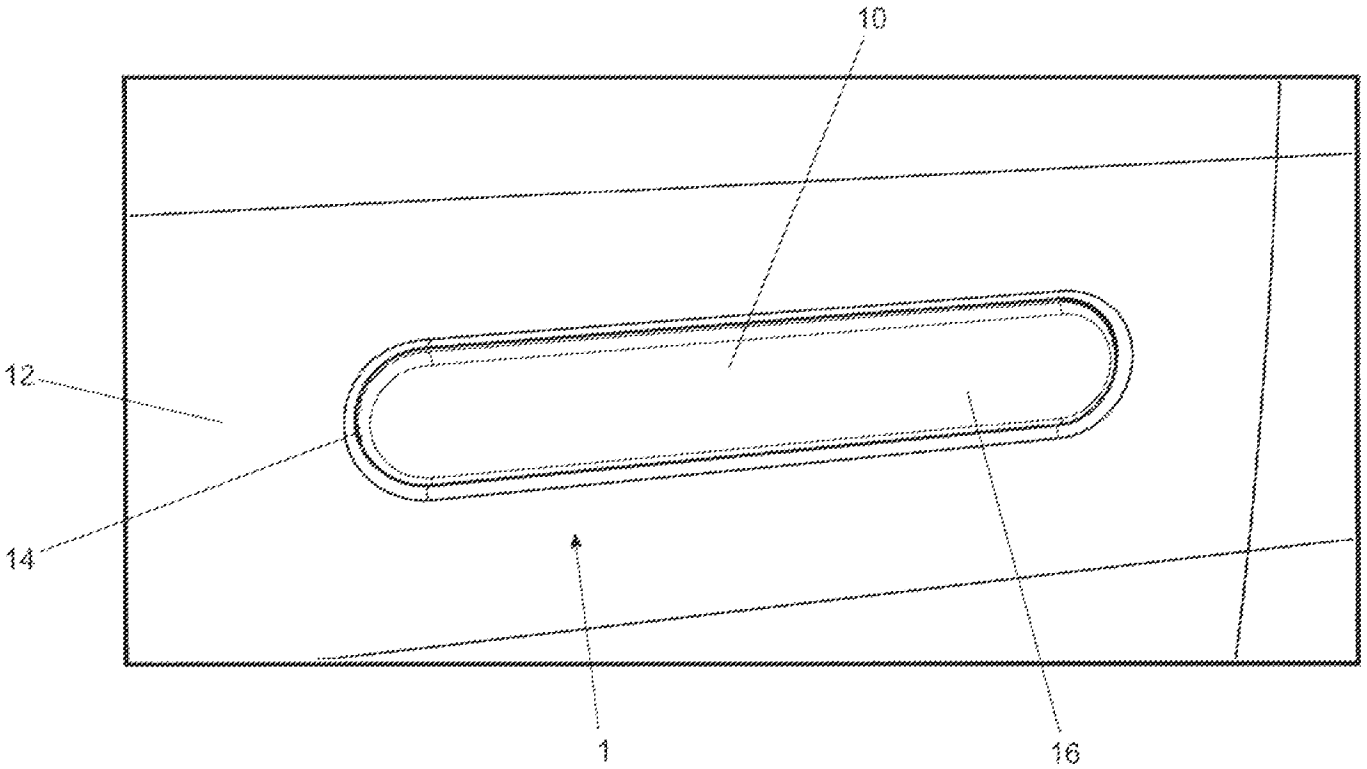
FIG. 1 is a perspective view from above of part of the exterior of a vehicle door fitted with a door handle arrangement in accordance with an embodiment of the present invention, the door handle being shown in a stowed state.

Referring to FIG. 1, in a door handle arrangement 1 of one embodiment of the invention, a flush-mounted door handle 10 is retractable with respect to a door of a vehicle. A painted door skin 12 is shown here to represent the door. The retractable handle arrangement 1 provides a handle 10 which is operable to be deployed automatically, or manually, in response to a user interaction; the handle 10 is deployed to a deployed position from a stowed condition. Once in a deployed position, or at least partially deployed position, the handle 10 is operable to be moved to an operative position to release a door latch. When the handle 10 is in the deployed position the door is unlocked.

The door skin 12 is penetrated by a horizontally-extending slot 14 that receives the handle 10 as a close fit. The outer surface 10 of the handle 10 is shaped to match the slot 14 and lies flush with the surrounding door skin 12 when the handle 10 is stowed as shown in FIG. 1. The shape of the slot 14 and of the outer surface 16 of the handle 10 is chosen for aesthetic reasons and is largely immaterial in terms of function.

Whilst shown in a contrasting tone for clarity in the drawings, at least the outer surface 16 of the handle 10, and possibly the entire handle 10, is painted in the same colour as the vehicle body. Other finishes may, of course, be chosen instead, again for aesthetic reasons.

Figure 2:
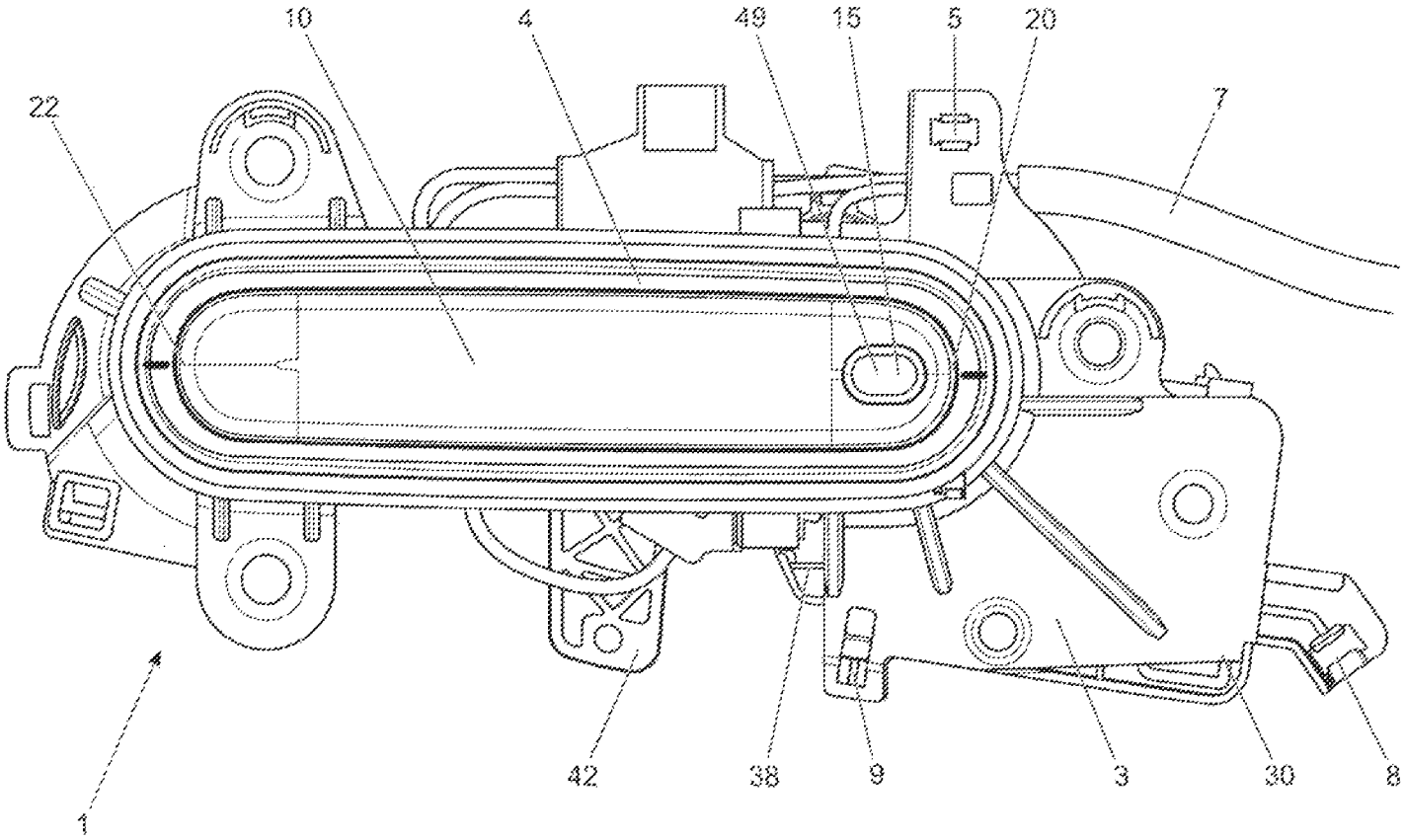
FIG. 2 is a front piers view of the mechanism of the door handle arrangement of FIG. 1, with the door handle in the stowed state.
Figure 3:
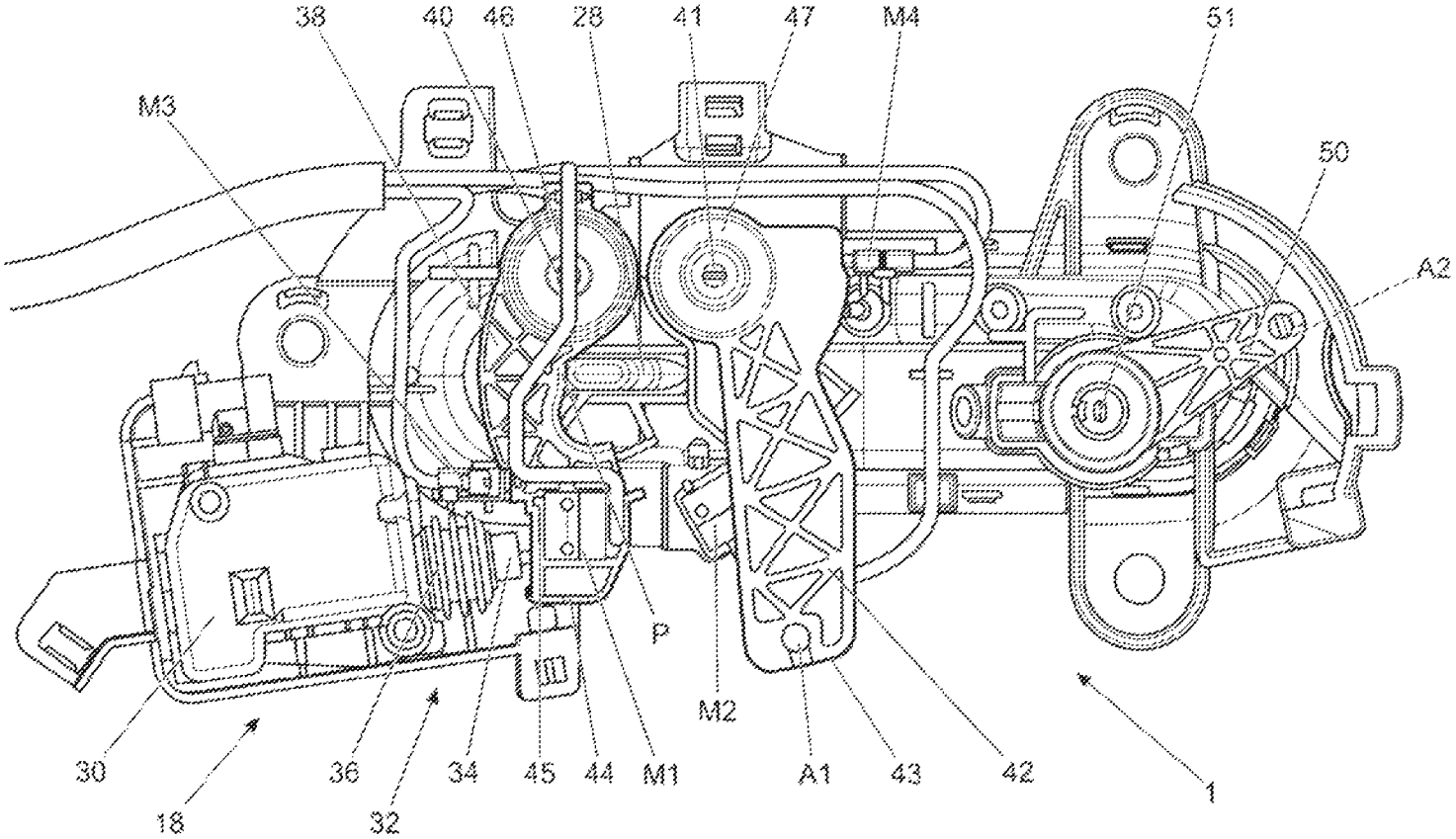
FIG. 3 is rear plan view of the mechanism of the door handle arrangement of FIG. 1, with the door handle in a stowed state.
Figure 4:
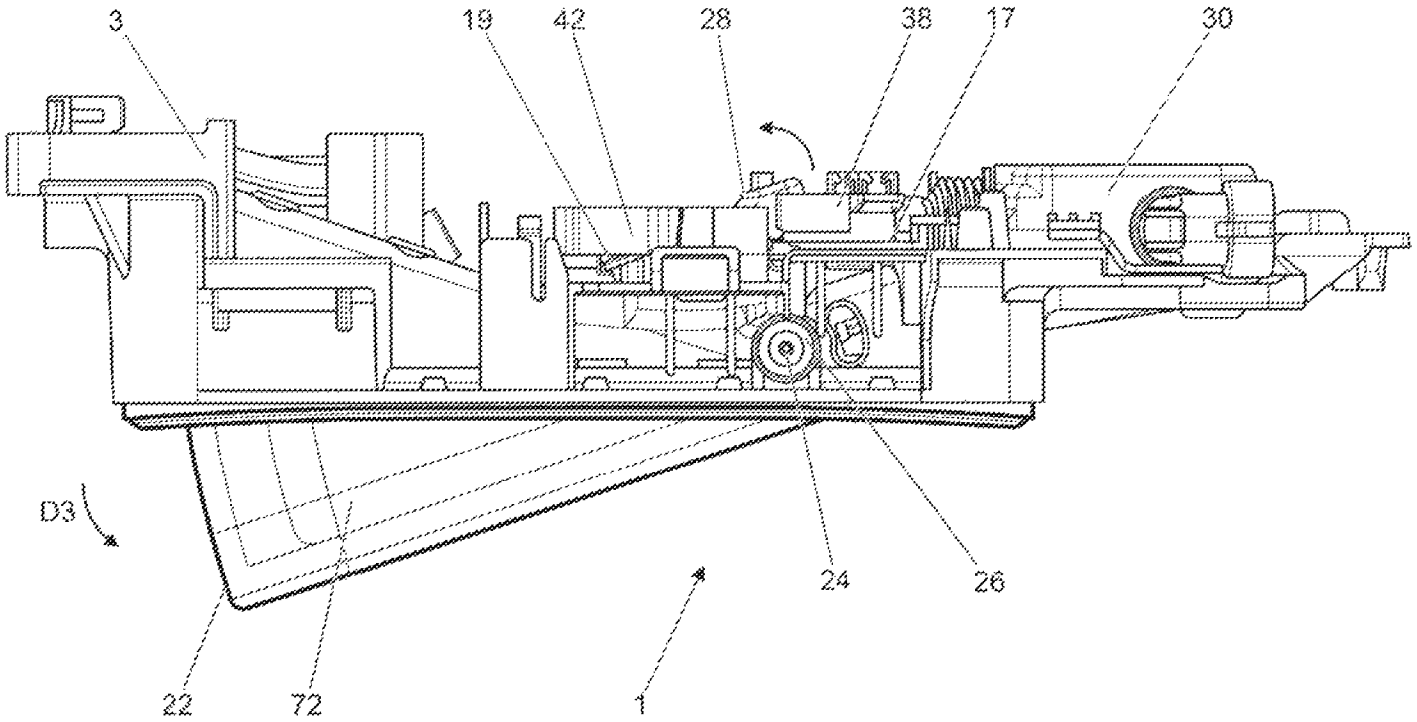
FIG. 4 is top plan view of the mechanism of the door handle arrangement of FIG. 1, with the door handle in the deployed state.

Referring to FIGS. 2, 3 and 4, the retractable handle arrangement 1 comprises a mechanism 18 which is operable to move the handle 10 between the stowed state (herein also referred to as a stowed condition and stowed position) and a deployed state (herein also referred to as a deployed condition and deployed position), as will be described in more detail later.

The handle 10 is provided in a housing 3, the housing 3 having an aperture for receiving the handle 10. A sealing element 4 is provided to form a seal between the handle 10 and the housing 3 and/or the door skin 12. The handle 10 is an elongate member having first and second ends 20, 22. Pivot means 24 is disposed proximate to the first end 20 and defines an axis about which the handle 10 is rotatable, when the handle 10 moves between the stowed and deployed states. In some embodiments a return spring 26 is provided on the pivot means 24 so as to bias the handle 10 toward the stowed position. An operating member 28 projects perpendicularly from an inner surface of the handle 10, which inner surface is disposed opposite the outer surface 16. The operating member 28 is disposed at substantially the same distance along the length of the handle 10 from the first end 20 as the pivot means 24.

The mechanism 18 comprises a motor 30 which is coupled to transmission means 32. The transmission means 32 comprises a piston 34 and a lever arm 38. The piston 34 may be surrounded by an expandable sealing member 36 to prevent or reduce ingress of dirt or moisture into the motor 30, the sealing member 38 may also serve to retain a lubricant such as grease. The piston 34 may be coupled to the motor 30 by a rack, crank mechanism or cam, when a rack is employed a pinion gear or worm gear may be used to drive the rack linearly. The advantage of employing a cam mechanism is that the force and the speed with which the piston 34 is extended or retracted can be controlled or modulated. In alternative embodiments the lever arm 38 may be coupled directly to a cam mechanism. GB1110487.4, and PCT/EP2012/062040, in the name of the same applicant and titled "RETRACTABLE HANDLE ARRANGEMENT FOR A DOOR OR THE LIKE", the contents of which are incorporated herein in their entirety, discloses such a cam mechanism, suitable for pivotally moving lever arm 38.

The lever arm 38 has first and second ends 44, 46 and is pivotally mounted about a lever axis 40 which is at least substantially perpendicular to the direction of travel of the piston 34. The lever axis 40 is disposed toward the second end 46, substantially at or proximate the second end 46, of the lever arm 38. The piston 34 abuts a first surface of the lever arm 38 substantially at or proximate the first end 44 of the lever arm 38. The operating member 28 of the handle 10 abuts the lever arm 38 between the lever axis 40 and the first end 44 of the lever arm 38. The operating member 28 of the handle 10 abuts the lever arm 38 on a second surface of the lever arm 38 opposing the first surface; the point of contact between the operating member 28 of the handle 10 and the lever arm 38 is disposed towards the second end 46 of the lever arm 38.

The lever arm 38 is biased against the piston 34 by a return spring 17, as shown in FIG. 4, such that the lever arm 38 is biased to return to a stowed position. In some embodiments the return spring 17 is configured and arranged to engage with the operating member 28 and biases the operating member 28 against the lever arm 38 such that both the lever arm 38 and operating member 28 are biased to return to a stowed position by the return spring 17.

The retractable handle arrangement 1 comprises a second lever arm 42; second lever arm 42 is disposed on an opposing side of the operating member 28 to that of the lever arm 38. The second lever arm 42 has first and second ends 43, 47 and is pivotally mounted about a lever axis 41 which is substantially perpendicular to the direction of travel of the piston 34. The lever axis 41 is disposed toward the second end 47, substantially at or proximate the second end 47, of the lever arm 42.

In some embodiments, in the stowed condition the second lever arm 42 is spaced apart from the operating member 28, that is to say they are not in physical contact. When the handle 10 is deployed to the deployed position the operating member 28 is rotated such that it is substantially brought info contact, or at least close proximity, with a portion of the second lever arm 42. In alternative embodiments, the second lever arm 42 is biased against the operating member 28, by a return spring 19 when in the stowed condition; the return spring 19 facilitates returning the handle 10 to the stowed condition since the second lever arm 42 acts upon the operating member 28. In other embodiments the second lever arm 42 is only biased against the operating member 28 when the handle 10 and hence the operating member 28 are moved from the deployed state to the operative condition. The retractable handle arrangement 1 may comprises an end stop which prevents the second lever arm 42 acting against the operating member 28 when returning from the deployed state to the stowed state.

In the deployed position the operating member 28 of the handle 10 substantially abuts the second lever arm 42 between lever axis 41 and first end 43 of the lever arm 42. The point of contact where the operating member 28 of the handle 10 abuts second lever arm 42 is disposed towards the second end 47 of the second lever arm 42.

An aperture A1 is provided in the second lever arm 42; aperture A1 is disposed substantially at the first end 43 of the second lever arm 42. Aperture A1 is coupled to a coupling member 74 such as a Bowden cable (shown in FIG. 8) which coupling member 74 is coupled to a door latch (not shown).

It will be appreciated that lever arm 38 forms a second class lever, whereas second lever arm 42 forms a third class lever.

The retractable handle arrangement 1 comprises a plurality of micro-switches M1, M2, M3, M4. The micro-switches M1, M2, M3, M4, and switch 15, are electrically coupled to a control module 54 (see FIG. 10) by a wiring harness 7.

Micro-switch M1 is mounted upon the lever arm 38 towards the first end 44; a spring mechanism 45 is mounted on live lever arm 38 and is disposed between the micro-switch M1 and the piston 34. When the handle 10 is in a deployed condition the micro-switch M1 is activated by a user exerting a force upon the handle 10 in a direction so as to push the handle towards the stowed condition. As a consequence the spring mechanism 45 is pushed against the end of piston 34 and in turn the spring mechanism is acts upon micro-switch M1. The spring mechanism 45 provides haptic feedback to the user to inform the user that the switch has been activated in some embodiments an audible click as the spring mechanism 45 returns to its unbiased condition may also provide feedback to the user. In response to activation of the micro-switch M1, the control module 54 is configured and arranged to instruct the handle arrangement 1 to return the handle 10 to the stowed position and to lock the door. In some embodiments the retractable handle arrangement may provide visual feedback in addition, or in the alternative, to aural or haptic feedback, for example by activating a light mounted on the retractable handle arrangement or elsewhere on the vehicle. In some embodiments the aural feedback may fake the form of an electronic beep or other noise, this may be generated by a security system mounted on the vehicle for example.

Micro-switch M2 is a limit switch, and is activated by the lever arm 38 when the lever arm 38 is driven to the deployed position. When the micro-switch M2 is activated the control module 54 is configured and arranged to instruct the motor 30 to stop extending the piston 34.

Micro-switch M3 is a limit switch, and is activated by the lever arm 38 when the lever arm 38 is returned to the stowed position. When the micro-switch M3 is activated the control module 54 is configured and arranged to instruct the motor 30 to stop retracting the piston 34.

Micro-switch M4 is optional, and may be used to activate a function as, or before, the handle 10 is moved from the deployed position to the operative position; for example micro-switch M4 may be provided on vehicles which comprise frameless door windows, (such windows generally extend into the vehicle body or frame to form a seal; in order to open the door it is necessary to withdraw the window from the vehicle body or frame, by at least partially retracting the window into the door). When the micro-switch M4 is activated the control module 54 is configured and arranged to instruct to instruct the window system to retract the window into the door.

In alternative embodiments the microswitch M4 may be omitted, the system may be programmed to detect a request for deployment of the door handle 10 to the deployed state and initiate movement of the door window to withdraw the window from the vehicle body or frame. Alternatively, upon receiving an instruction to deploy the handle 10, the system may be configured to send an instruction to an actuator provided for partially retracting or dropping the door window sufficient to allow the door to be opened. The same actuator may be used for deploying the handle and for partially retracting or dropping the door window sufficient to allow the door to be opened, in which case the window may be partially retracted or dropped automatically when the handle is deployed. In such embodiments it is envisaged that the door window would be retracted before the handle 10 reacted fully deployed state, thus reducing the likelihood of a user opening the door whilst the door window is raised up within the vehicle body or frame.

In the stowed state illustrated in FIGS. 1, 2 and 3, the outer surface 16 of the handle 10 lies flush with the surrounding door skin 12. The handle 10 may be automatically driven from its stowed state to its deployed state in response to various events. For example, this movement may be in response to an unlocking signal from a key authorized to unlock the vehicle or from a presence sensor that detects the presence of an authorized key in the immediate vicinity of the vehicle. Conversely, the handle 10 may be automatically driven, or biased to return, from its deployed state to its stowed state in response to a locking signal from a key authorized to lock the vehicle or from a presence sensor that determines that the authorized key has left the immediate vicinity of the vehicle. The handle 10 may also toggle between the stowed and deployed states in response to a further action from the user, for example pressing a switch (not shown in FIG. 1) on the vehicle door.

Figure 5:
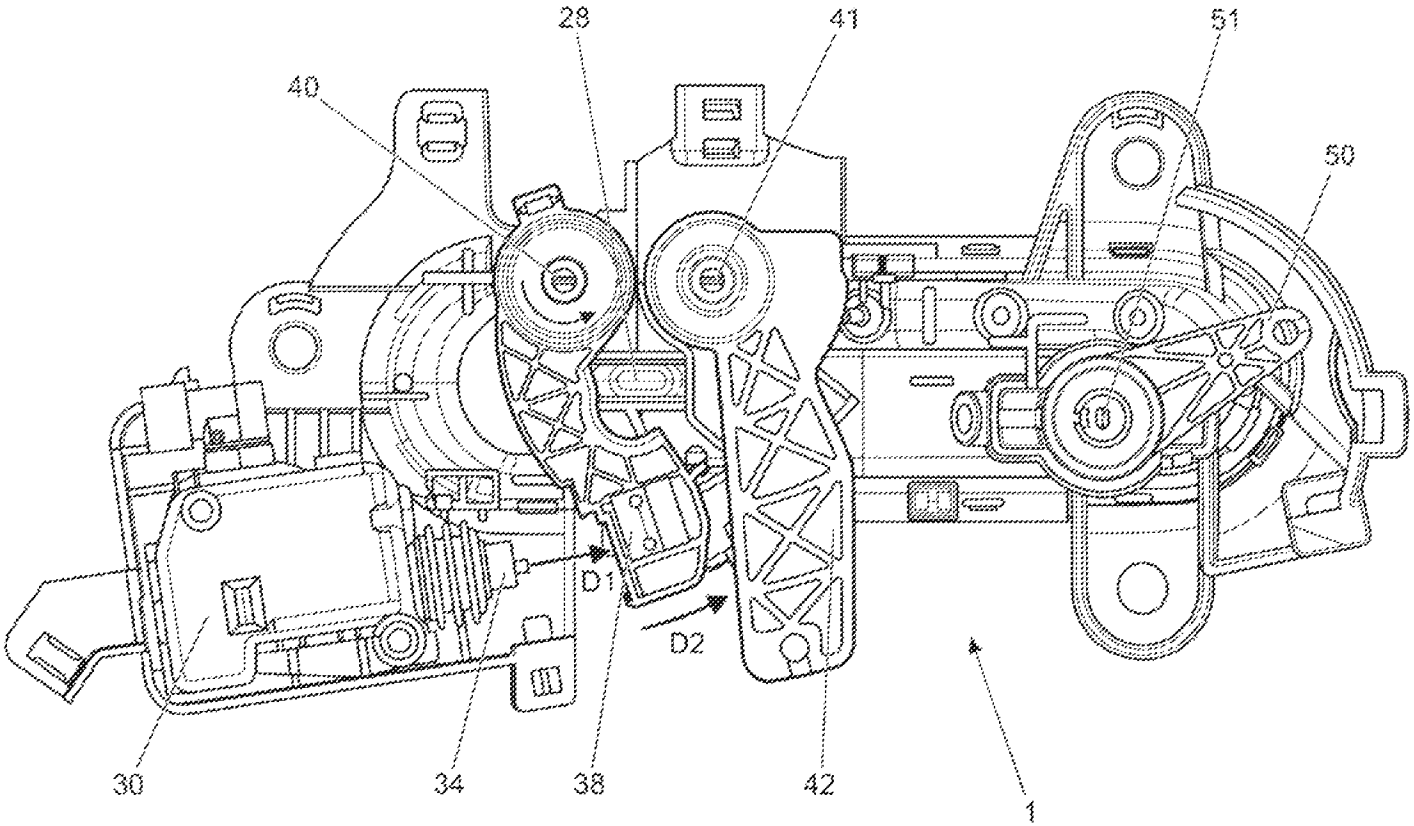
FIG. 5 is rear plan view of the mechanism of the door handle arrangement of FIG. 1, with the door handle in the deployed state.
Figure 6:
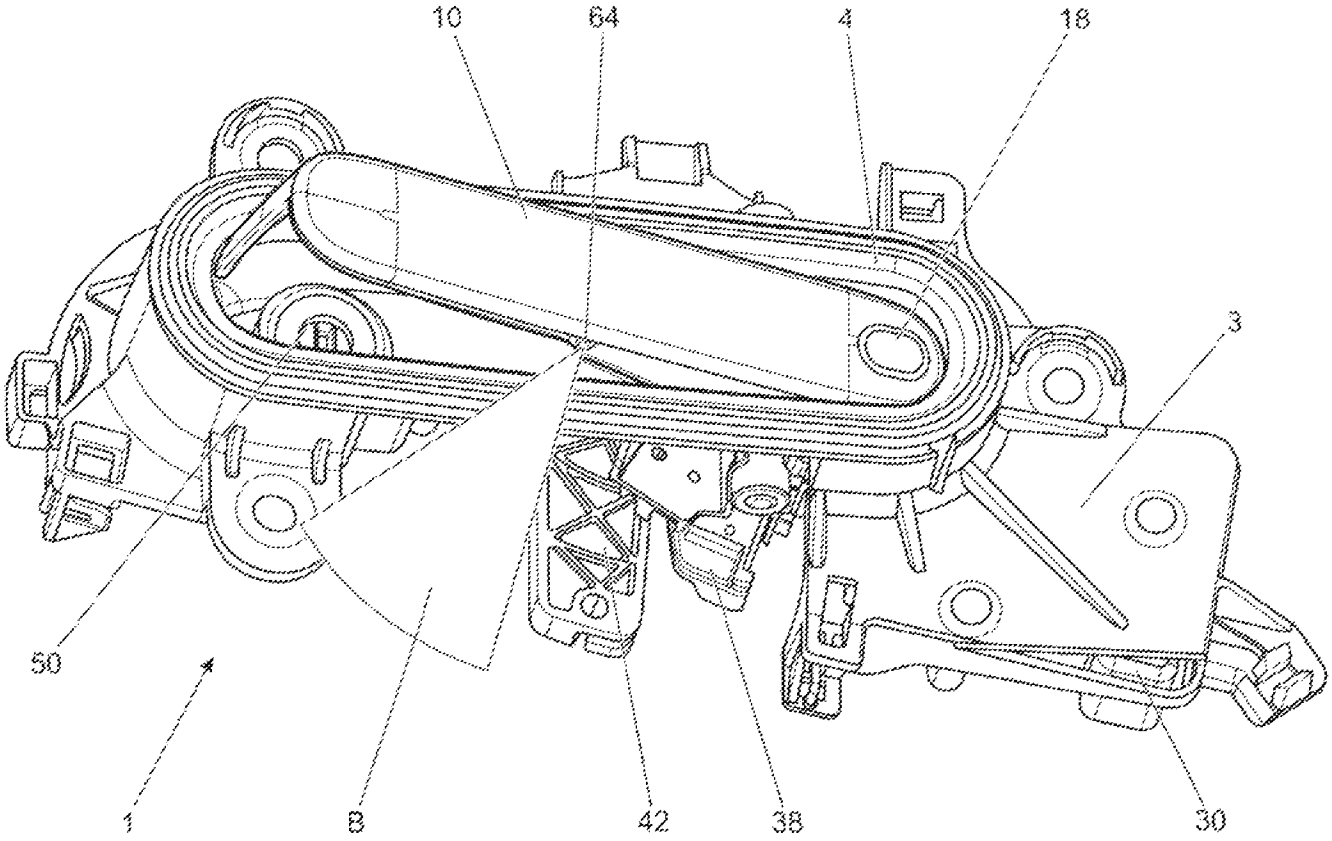

Referring to FIGS. 4, 5 and 6, in its deployed state, the handle 10 is rotated about the pivot means 24 against the biasing force of the return spring 17 and/or return spring 26 such that the second end 22 of the handle protrudes from the slot 14 (not shown in FIGS. 4, 5 and 6) by an amount sufficient to allow a user to put their fingers around the handle 10.

In the embodiment of the invention shown in FIGS. 4, 5 and 6, the retractable handle arrangement 1 comprises a top cover portion 72 which extends substantially perpendicular to the inner surface along the length of the handle 10 and along a portion of the second end 22.

The presence of the top cover portion 72 requires a user to grasp the handle 10 with an underhand grip in order to open the associated door. An advantage of this handle configuration over the bar-type handle described previously is that the top cover portion 72 may prevent items, such as clothing, bag straps, etc. from becoming looped over the handle 10 when it is in the deployed state. Accordingly, such a handle offers an improved safety aspect.

Figure 7:
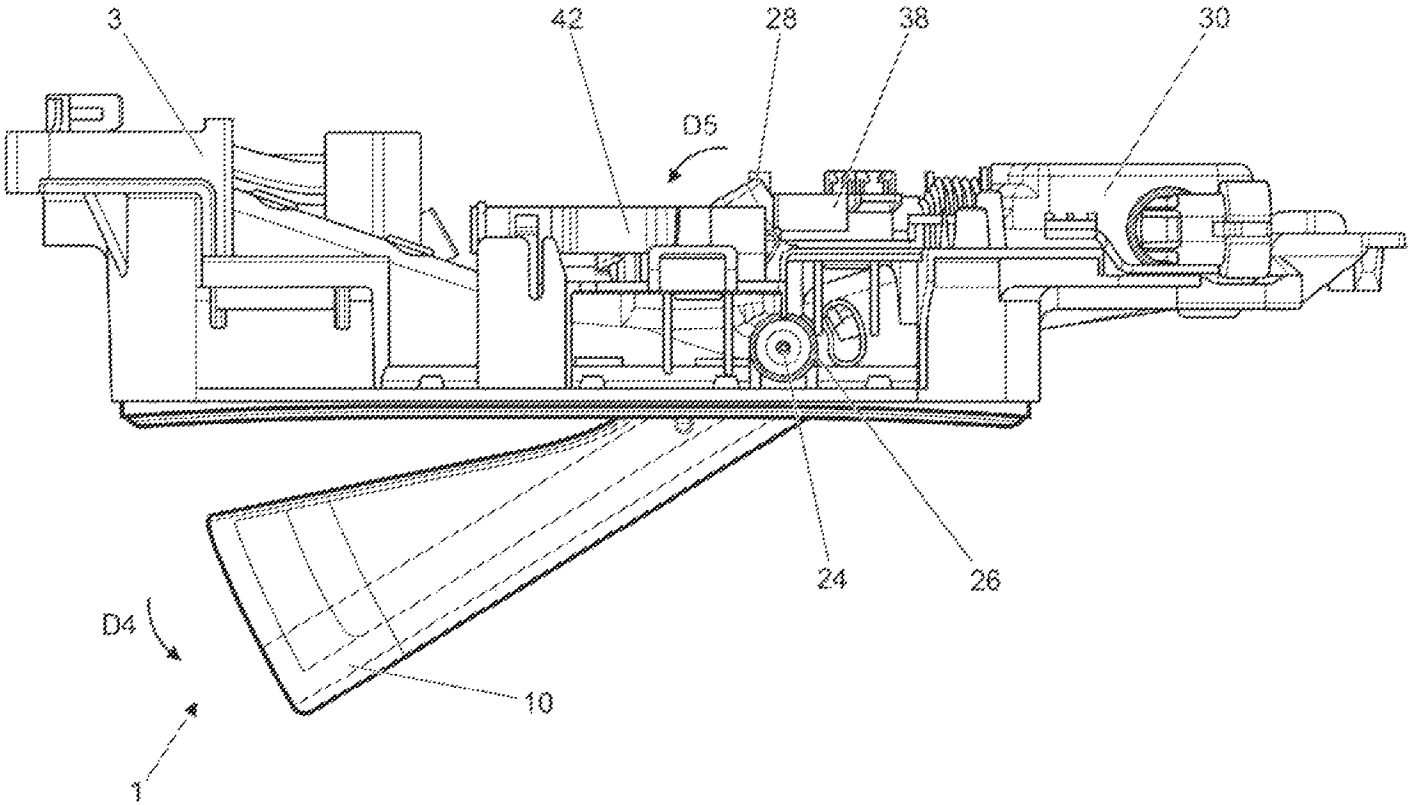
FIG. 7 is a top plan view of the mechanism of the door handle arrangement of FIG. 1, with the door handle in the operative state.
Figure 8:
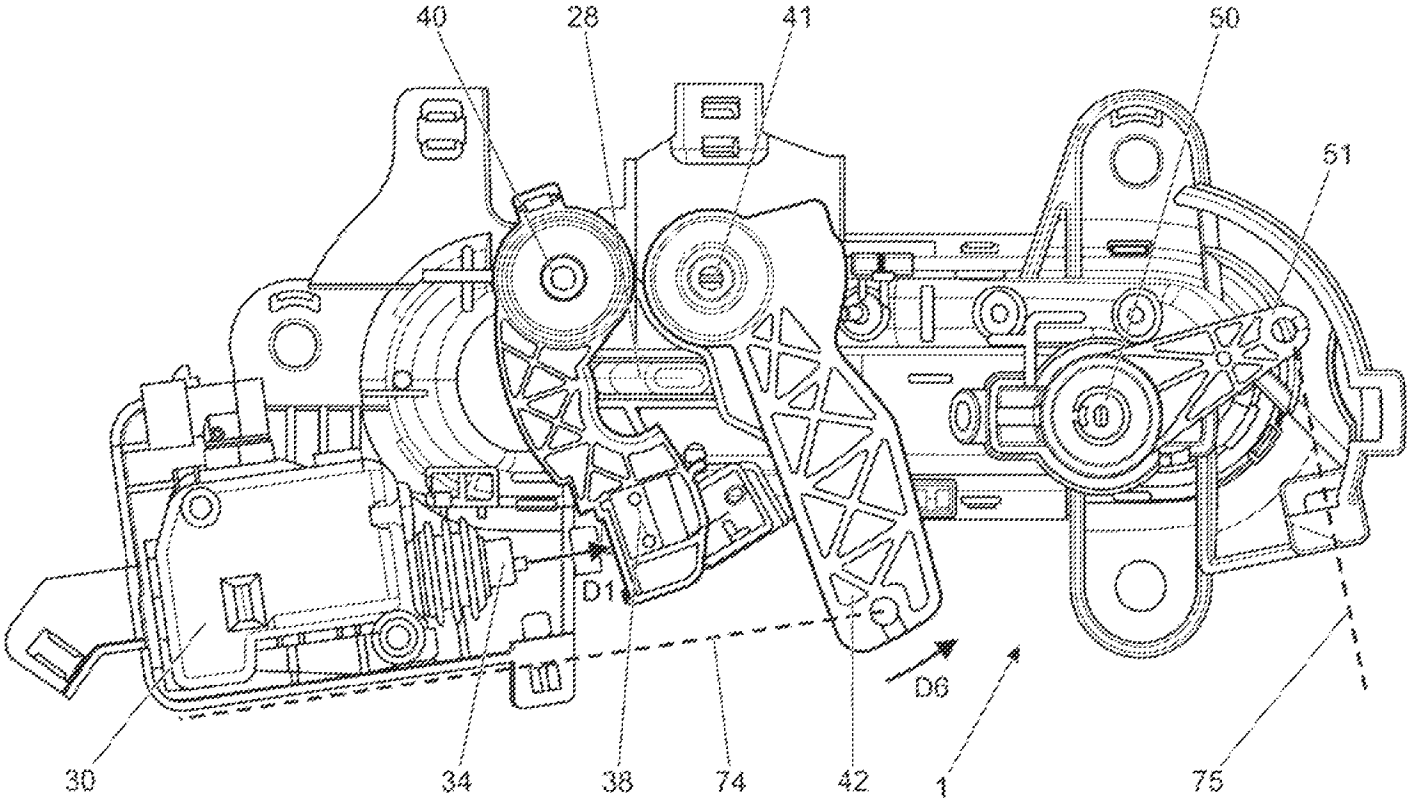
FIG. 8 is perspective view from below of the mechanism of the door handle arrangement of FIG. 1, with the door handle in the deployed state.
Figure 9:
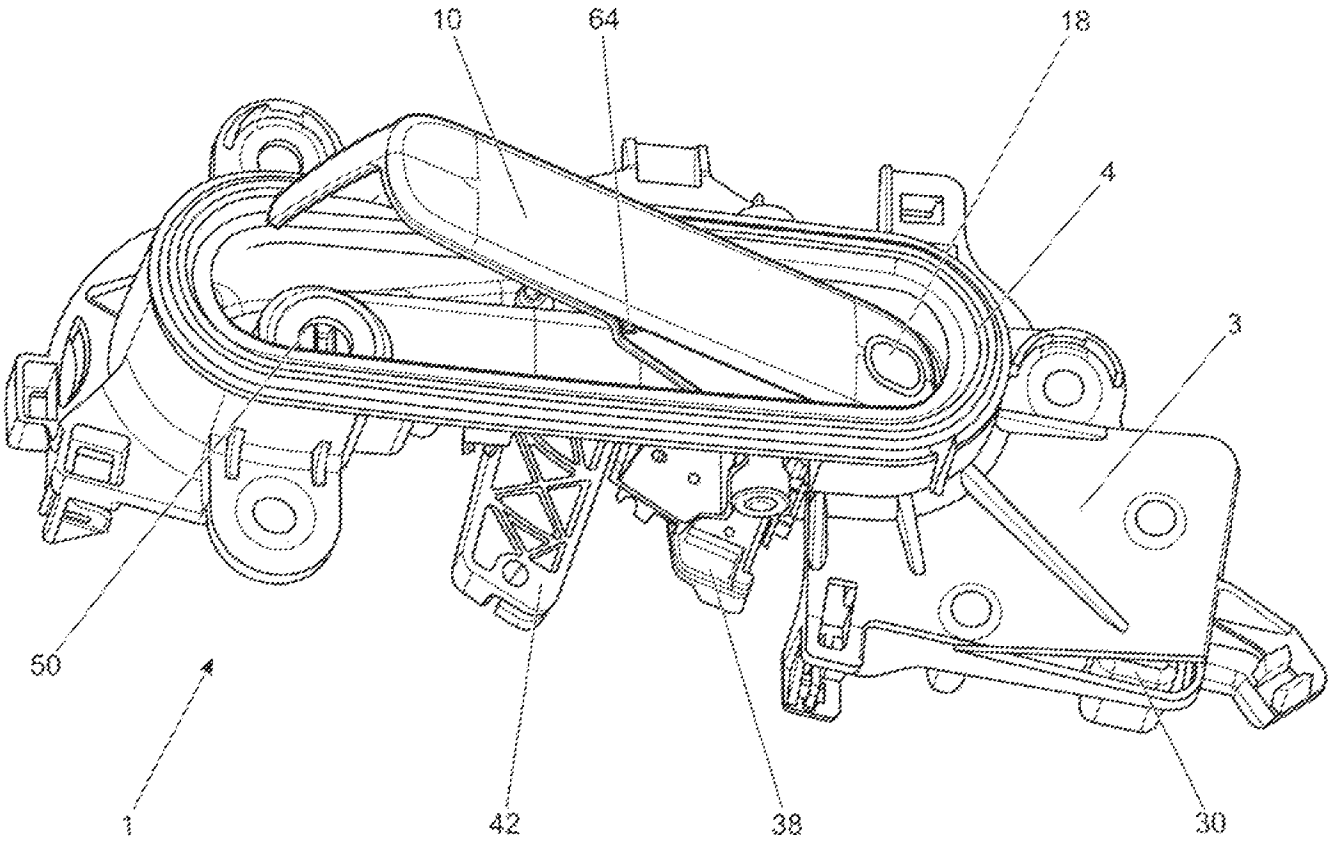
FIG. 9 is perspective view from below of the mechanism of the door handle arrangement of FIG. 1, with the door handle in the deployed state.

As explained previously, when the handle 10 is in the operative state, this causes the door to be opened. The operative state, as shown in FIGS. 7, 8 and 9 corresponds to a position in which the handle 10 is further rotated about the pivot means 24 beyond the deployed state.

The operation of the retractable handle arrangement 1 will now be described in more detail.

Referring to FIGS. 3, 4, and 5, with the handle 10 in the stowed state, the lever arm 38 and second lever arm 42 are disposed substantially vertically. The return spring 26 and/or return spring 17 acts to bias the handle 10 towards the stowed state. Accordingly, the operating member 28 of the handle 10 presses against the lever arm 38 which, in turn, causes the first end 44 of the lever arm 38 to press against the piston 34. In order to deploy the handle 10, the motor 30 is driven to extend the piston 34 such that the piston 34 is extended in the direction of arrow D1 as shown in FIG. 5.

Referring to FIGS. 4, 5 and 6, extension of the piston 84 causes the lever arm 38 to be pivoted about the lever axis 40. The first end 44 of the lever arm 38 moves in the direction of the arrow D2, as shown in FIG. 5. The lever arm 38 presses against the operating member 28 of the handle 10 thereby causing the handle 10 to rotate about its pivot means 24 in the direction of arrow D3, as shown in FIG. 4, until it reaches the deployed position at which point the micro-switch M3 is activated and the motor 30 stops.

The motor 30 and lever arm 38 are selected so as to be sufficient to break through any ice, in the event that the handle 10 is subjected to wet and freezing conditions (the required force may be about 200 N).

In order to retract the handle 10 from the deployed state back into the stowed state, the motor 30 is driven in reverse which, in turn, refracts the piston 34 in the direction opposite to arrow D1 in FIG. 5. The biasing force of the return spring 26 and or return spring 17 causes the handle 10 to move toward the stowed slate. As the handle 10 retracts, the operating member 28 causes the lever arm 38 to rotate back to its initial position shown in FIG. 3. Accordingly, during retraction of the handle 10, although the motor 30 is driven, the mechanism 18 does not exert a closing force on the handle 10. This is advantageous because, in the event that a user is holding the handle 10 as it retracts, the force against the users hand is limited to that of the return springs 26, 17.

A user may initiate retraction of the handle 10 by pressing on the handle between the second end 22 and the pivot point 24 so as to activate the micro-switch M1.

The speed at which the handle is deployed may be varied by adjusting the speed of the motor 30; this may be achieved by reducing the voltage supply to the motor 30. In some embodiments this is achieved by modulating the voltage supply with a signal effectively turning the voltage supply on and off thereby reducing the effective voltage across the motor 30. During an initial deployment phase, the handle 10 moves relatively slowly. In a second deployment phase, the voltage supply is increased. This results in the handle 10 being moved at a higher speed.

In a further embodiment of the present invention, the voltage supply may be modulated such that there is a third deployment phase of the handle 10. In more detail the voltage supply is decreased after the second deployment phase. Accordingly, after the handle 10 is moved quickly during the second phase, if slows down gradually during the third phase until it stops in the deployed state, thereby producing a pleasing aesthetic effect.

It will be appreciated by those skilled in the art that, whilst the above description refers to initial second and third deployment phases, the voltage supply may be modulated such that the transitions between each of the deployment phases are continuous.

Referring to FIGS. 7, 8 and 9, in order to open the door a user operates the handle 10 by pivoting the handle 10 about the pivot means 24; the user pulls the second end 22 of the handle 10 in the direction indicated by direction arrow D4 until the handle 10 reaches en operative position. In doing so the operating member 28 rotates in the direction indicated by direction arrow D5 and engages with the second lever arm 42, pivotally moving the second lever arm 42 about the pivot axis 41 in the direction indicated by direction arrow D6. Thus the second lever arm 42 pulls the coupling member 74 thereby releasing the door latch. Coupling member 74 is mounted on the housing 3 by clips 8, 9. When the user releases the handle 10 the return spring 19 acts upon the second lever arm 42 to return the second lever 42 to the deployed position and in doing so the second lever 42 acts upon the operating member 28 to return the handle 10 to the deployed position. The operating member 28 return to the deployed position in which position the operating member 28 is in contact with the lever arm 38.

Referring again to FIG. 2, the handle 10 may also comprise an unlock button 49 disposed on the outer surface 18 thereof, the unlock button 40 is coupled to a switch or sensor 15. The unlock button 49 may be touch sensitive buttons, i.e. capacitive sensors, or it may be a micro-switches. The full functionality of the unlock button 49 will be described in more detail later. However, the position of the unlock button 49 on the handle 10 is selected so as to be both intuitive for the user and to reduce the possibility of incorrect use of the handle arrangement 1.

The unlock button 49 is disposed adjacent to the first end 20 of the handle 10. As mentioned previously when a user operates the handle 10 the user's thumb will typically be at the first end 20. Thus, when a user presses the unlock button 49 with their thumb, which unlocks the associated door and causes the handle 10 to be moved into the deployed state, their hand is naturally positioned such that it is easy and convenient for them to grasp the deployed handle 10 and open the door by pulling it to the operative position.

Furthermore, the unlock button 49 is advantageously positioned in the event that a user is required to deploy the handle 10 manually, for example, if there is a loss of power to the motor 30, in this case, as the user applies pressure to the unlock button 49, the associated door will be unlocked as before. Subsequently, as the user applies increased pressure on the unlock button 49, the handle 10 will be rotated about the pivot means 24 against the biasing force of the return spring 26. Once the second end 22 of the handle protrudes from the slot 14, the user can grasp the handle 10 and pull it to the operative state to open the door. Accordingly, the handle 10 can be manually deployed by a user simply applying pressure at the unlock button 49, without requiring any more complex actions which require a greater degree of dexterity. The user may deploy the handle 10 with a single hand, for example by application of a force to the handle 10 between the first end 20 and the pivot point 24 with a thumb of one hand and then subsequently grasping or pulling the handle 10 between the second end 22 and the pivot point 24 with one or more fingers of the same band to operate the handle 10. The handle 10 may be moved from the stowed position of the deployed condition either manually or automatically.

In an alternative embodiment the unlock button 49 may be located proximate to the second end 22, the user may deploy and operate the handle 10 with a single hand; the user may press the unlock button 49 with a thumb such that the handle 10 is deployed automatically, the user may subsequently grasp the handle 10 between the second end 22 and the pivot point 24 with one or more fingers of the same hand to operate the handle 10.

In the embodiment illustrated in FIG. 2 the pivot point 24 is located closer to the first end 20 than to the second end 22, it is envisaged that the first end 20 would be disposed forwardmost with respect to the vehicle and a user when employing single handed operation would engage the handle 10 with an underhand grip in other words from below with their right hand.

In other embodiments other configurations ere envisaged, for example, but not limited to, the pivot point 24 may be located closer to the first end 20 than to the second end 22 end the second end 22 may be disposed forwardmost, a user when employing single banded operation would engage the handle 10 with an overhand grip in ether words from above with their right hand. Alternatively, the pivot point 24 may be located closer to the second end 22 than to the first end 20, it is envisaged that the first end 20 may be disposed forwardmost, a user when employing single handed operation would engage the handle 10 with an underhand grip in other words from below with their left hand. In a further alternative the pivot point 24 may be located closer to the second end 22 than to the first end 20, it is envisaged that the second end 22 may be disposed forwardmost with respect to the vehicle, a user when employing single handed operation would engage the handle 10 with an overhand grip in other words from above with their left hand.

Furthermore, with the above described arrangement, the functions of the unlock button 49 will be intuitive to a user unfamiliar with the operation of the handle arrangement 1. In particular, the position of the unlock button 49 at the first end 20 of the handle 10 will be associated in the mind of the user with opening the door because pressure at this position on the handle 10 causes the handle 10 to move from the stowed to tire deployed state. In order to operate the lock function the user need only press the handle 10 towards the stowed position, the spring mechanism 45 allows a predefined degree of movement of the handle 10 during which movement the force transferred to the piston 34 and motor 30 is limited, thereby reducing the likelihood of damage to the piston 34, motor 30 and/or drive mechanism therebetween.

Figure 10:
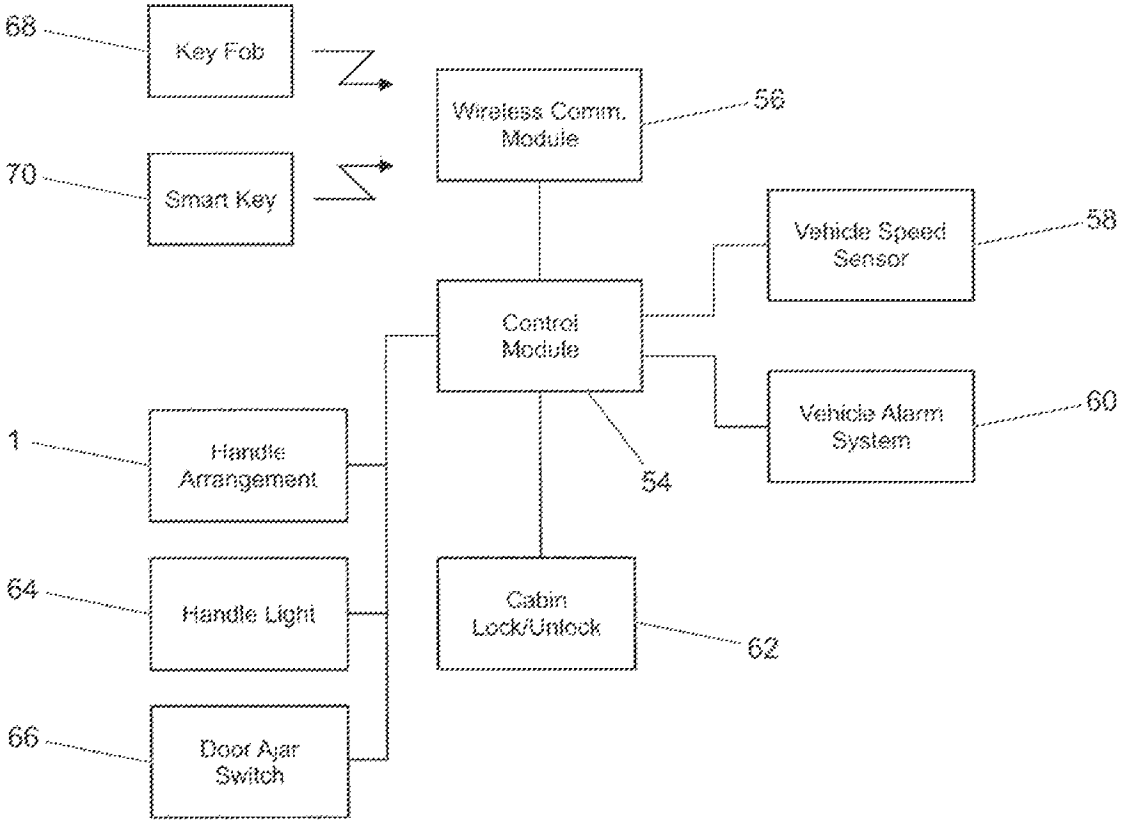
FIG. 10 shows schematically en embodiment of a system for controlling the operation of the retractable handle arrangement of FIG. 1.

Referring to FIG. 10, a system for controlling a retractable handle arrangement 1 of the kind described above comprises a control module 54 for controlling the mechanism 18 of each retractable handle arrangement 1 on a vehicle. Although only a single handle arrangement is shown in FIG. 7, it will be appreciated that, each door of the vehicle may be provided with a retractable handle arrangement 1.

The control module 54 is also coupled to a wireless communication module 56, a vehicle speed sensor 58, a vehicle alarm system 60, door lock and unlock controls in the vehicle cabin 62, a handle light 64 and a door ajar switch 66. The wireless communication module 56 is operable to receive signals from a vehicle key fob 68. The key fob 26 is provided with respective door lock and unlock buttons and means for transmitting respective lock and unlock signals to the wireless communication module 56 in response to a user pressing the relevant button. The wireless communication module 56 is also operable to detect the presence of a smart key 70 within a target distance from the vehicle (typically 1-2 m) to enable passive entry. Also, the driver's door of the vehicle can be mechanically locked or unlocked from outside the vehicle via a key barrel 50 optionally positioned underneath the driver's door handle. Thus, the key barrel 50 will be revealed any time the handle is moved to the deployed or operative slate. The key barrel 50 is coupled to the door lock (or other function) of the vehicle by a coupling element 75 such as a Bowden cable mounted to one end of a lock lever 51. The key barrel 50 passes through an aperture in the housing 3; the lock lever 51 is mounted to an internal end of the key barrel 50.

Each retractable handle arrangement 1 may comprise a light 64, such as an LED, for illuminating the handle 10 and its immediate surroundings so as to facilitate the opening of the doors in low-light conditions. In some embodiments the LED may be mounted to an inner surface of the handle 10 proximate a lower edge of the handle 10 and be configured to point downwardly, away from top cover portion 72. In yet other embodiments the LED is mounted in a different location as packaging space allows, a fibre optic cable or other suitable light channeling device is coupled at one end to the LED. The other end of the fibre optic cable is mounted to an inner surface of the handle 10 proximate a lower edge of the handle 10 and is configured to point downwardly, away from top cover portion 72. Each retractable handle arrangement 1 may also comprise a pair of limit switches for detecting when the handle 10 is in each of the stowed and deployed states.

The operation of the control module 54 will now be described in more detail.

When the vehicle is parked, each handle 10 is in the stowed state, i.e. flush with the door skin 12, when its associated door is locked, and each handle 10 is in the deployed state when its associated door is unlocked. Deployment of the handle 10 is thus triggered by unlocking; and refraction of the handle 10 is triggered by locking.

Locking and unlocking are triggered by either using the lock and unlock buttons on the key fob 68 or by the passive entry unlock button 49 provided on each handle 10 and activating the micro-switch M1 by pushing the handle 10. Optionally, a lock button (not shown) may be provided on the handle, the lock button may be located on the outer surface 16 of the handle substantially at the point at which the handle 10 pivots. More specifically, for access via passive entry, the user carries the smart key 70 on their person. When the smart key 70 is within a target range of a particular door handle 10 (typically 1-2 m) and the door unlock button 49 is operated, the control module 54 is operable to verify the presence of the smart key 70, by virtue of a signal received via the wireless communication module 56, and the handles 10 of all unlocked doors are deployed. The user can then open an unlocked door by pulling the associated handle 10 from the deployed state to its operative position as shown in FIGS. 7, 8 and 9 thereby mechanically releasing the door latch. Each handle 10 returns to the stowed state when its associated door is locked. This may be achieved by a user pressing or pushing on the handle 10 or by means of a cabin lock button 62 within the vehicle or the lock button on the key fob 68.

In some embodiments deployment of the handle 10 from the stowed position to the deployed position may be initiated by a user pressing upon the handle between the second end 22 of the handle 10 and the pivot point 24 such that the second end 22 of the handle is urged inwardly of the door cavity so as to activate the microswitch M1 whilst the handle 10 is in the stowed position.

Accordingly, the deployment position of each handle 10 acts as a lock status indicator for each individual door. One exception to this may be provided when the vehicle is in motion in which case all the handles 10 of all doors, whether locked or unlocked, are in the slowed state. The handles 10 on any unlocked doors may be retracted into the stowed state in the event that the vehicle exceeds a threshold speed, for example, 5 miles per hour, which may be determined by the vehicle speed sensor 58. The handles 10 of the unlocked doors will then remain in the stowed state for the duration of the vehicle's journey and are only re-deployed in the case that the vehicle is determined to be stationary and either: (i) one of the doors is opened from the inside (which can be determined by means of the door ajar switch 66 provided on each door); (ii) in the case that an unlocked doors handle unlock button 49 is operated by a person, even without the smart key 70 present (such as when picking up a passenger); or (iii) if the cabin unlock button 62 is pressed.

Pressing the handle 10 once towards the vehicle to activate micro-switch M1, or pressing the optional lock button will centrally lock the vehicle and, if applicable, arm the vehicle alarm system 60. If the handle 10 or lock button is pressed a second time within a predetermined time period, e.g. 3 seconds, a deadlock will be activated. The handles 10 will be retracted to the stowed state in response to the first press of the handle 10 or lock button. A 'global close' may be affected by pressing and holding the handle 10 or lock button, i.e. this may automatically close any open windows, and, if applicable to the vehicle, deploy a retractable roof, etc.

The handle light 64 will be switched on when the vehicle is unlocked and turned off when the vehicle is locked. If the vehicle is left in an unlocked state for more than a predetermined period of time, e.g. 20 seconds, the system is configure to cause the light 64 to turn off. Also, the light 64 will not be activated, or will be deactivated, when the ignition is on or turned on.

A user need not wait for a handle 10 to fully deploy after pressing the handle unlock button 49 before opening the door, provided the user is able to group the handle 10 as it is being deployed sufficient to pull it to the operative state.

It can be appreciated that various changes may be made within the scope of the present invention, for example, in other embodiments of the invention it is envisaged that in an alternative embodiment of the invention, the handle 10 is a bar-type handle which can be grasped with either an underhand or an overhand grip. With such a bar-type handle, the users thumb will typically be positioned toward the first end 20 of the handle 10, when pulling the handle from the deployed state to an operative state.

The invention claimed is:

1. A handle arrangement for a vehicle comprising:

a handle moveable between a stowed position and a deployed position;

a drive mechanism for controlling the handle position;

at least one sensor configured to detect a movement of the handle toward the stowed position caused by a force applied to the handle when in the deployed position, the movement detected by the sensor prior to the handle reaching the stowed position, which force is directed so as to urge the handle towards the stowed position;

wherein the drive mechanism is responsive to the force applied to the handle when in the deployed position such that upon detecting the movement, the drive mechanism is configured to continue the movement of the handle toward the stowed position and thereby move the handle from the deployed position to the stowed position.

2. A handle arrangement for a vehicle according to claim 1 wherein the handle arrangement comprises a feedback device for indicating to a user that sufficient force has been applied to the handle to initiate the movement of the handle from the deployed position to the stowed position.

3. A handle arrangement for a vehicle according to claim 2, wherein the feedback device comprises one or more of an aural feedback device, a haptic feedback device and a visual feedback device.

4. A handle arrangement for a vehicle according to claim 1 wherein the handle arrangement is coupled to a lock mechanism of a door or other closure of the vehicle and wherein upon detecting the force the lock mechanism is arranged to be activated so as to lock the door or other closure.

5. A handle arrangement for a vehicle according to claim 4 wherein the handle arrangement is arranged to activate a dead lock mechanism of the door or other closure of the vehicle upon detecting application of a second force on the handle.

6. A handle arrangement for a vehicle according claim 1 wherein the handle is pivotally mounted about a handle pivot axis disposed between first and second ends of the handle.

7. A handle arrangement for a vehicle according to claim 6 wherein the handle pivot axis extends through and is disposed within the handle.

8. A handle arrangement for a vehicle according to claim 1 wherein the handle is coupled to the drive mechanism such that the handle may be moved from the stowed position to the deployed position manually, independently of the drive mechanism.

9. A handle arrangement for a vehicle according to claim 1 wherein the handle arrangement comprises a return spring for returning the handle from the deployed position to the stowed position.

10. A handle arrangement for a vehicle according to claim 1 wherein the handle arrangement comprises a key barrel for receiving a key blade, wherein the key barrel is disposed behind the handle such that the handle conceals the key barrel in the stowed position.

11. A handle arrangement for a vehicle according to claim 10 wherein the handle is pivotally mounted about a handle pivot axis disposed between the first and second ends, the handle pivot axis being arranged such that the key barrel remains substantially behind the handle in the stowed position and the key barrel and handle are disposed in the same plane which plane is substantially perpendicular to a plane comprising the handle pivot axis.

12. A handle arrangement for a vehicle according to claim 1, the handle having a first end and a second end, wherein the handle comprises an unlock button disposed proximate a first end of the handle such that a user may deploy the handle with one hand.

13. A handle arrangement according to claim 1, wherein the handle arrangement is configured to detect the handle being urged into the deployed position when the handle is in the stowed position;

wherein upon detecting the handle being urged into the deployed position when the handle is in the stowed position the drive mechanism is configured to move the handle from the stowed position to the deployed position.

14. A handle arrangement according to claim 1 comprising:

wherein the handle arrangement is configured to detect the handle being urged in the direction of the stowed position of the handle when the handle is in the stowed position;

wherein upon detecting the handle being urged in the direction of the stowed position when the handle is in the stowed position the drive mechanism is configured to move the handle from the stowed position to the deployed position.

15. A vehicle having a plurality of doors or other closures each of which comprises a handle arrangement according to claim 1 wherein a control unit is coupled to all of the handle arrangements provided on the vehicle.

16. A vehicle according to claim 15 wherein the control unit is arranged to determine whether to move one or all of the handle arrangements from the deployed position to the stowed position based upon a parameter of the force applied to one or more of the handles when in the deployed position and control the drive mechanism of each handle arrangement accordingly.

17. A vehicle according to claim 15 wherein the vehicle comprises a locking mechanism on each of the doors or other closures, and further wherein the control unit is arranged to activate the locking mechanism so as to lock one or all of the doors or other closures based upon a parameter of the force applied to one of the handles.

18. A vehicle according to claim 17 wherein the parameter is one of the following:

duration of the force;

magnitude of the force;

direction of the force; and number of times force is applied.

19. A vehicle having a handle arrangement as claimed in claim 1.

20. A vehicle according to claim 19 comprising one or more doors and wherein a handle acts as a lock status indicator for each individual door.

* * * * *